United States Patent [19]

Hayakawa

[11] Patent Number: 5,000,011

[45] Date of Patent: Mar. 19, 1991

[54] ENGINE DRIVEN AIR CONDITIONING APPARATUS

[75] Inventor: Seiji Hayakawa, Nagoya, Japan

[73] Assignee: Aisin Seiki Kabushiki Kaisha, Kariya, Japan

[21] Appl. No.: 330,466

[22] Filed: Mar. 30, 1989

[30] Foreign Application Priority Data

Mar. 30, 1988 [JP] Japan ..... 63-074654

[51] Int. Cl.[5] ..... F25B 27/00

[52] U.S. Cl. ..... 62/324.1; 62/243; 62/323.1

[58] Field of Search ..... 62/238.7, 238.6, 324.1, 62/324.5, 324.4, 323.1, 243; 165/29; 237/2 B

[56] References Cited

U.S. PATENT DOCUMENTS

| | | | |
|---|---|---|---|
| 3,128,608 | 4/1964 | Kleist | 62/243 |
| 3,209,551 | 10/1965 | Jentet | 62/243 X |
| 4,248,056 | 2/1981 | Beacham | 62/238.7 |
| 4,384,608 | 5/1983 | Scarlett et al. | 62/243 X |
| 4,688,394 | 8/1987 | Waldorf | 62/243 |
| 4,697,434 | 10/1987 | Yuyama | 237/2 B |
| 4,735,061 | 4/1988 | Hsieh | 237/2 B |
| 4,745,768 | 5/1988 | Schorr et al. | 62/238.6 |
| 4,754,614 | 7/1988 | Yuyama | 237/2 B |
| 4,805,689 | 2/1989 | Inada et al. | 62/238.7 |

*Primary Examiner*—Lloyd L. King

*Attorney, Agent, or Firm*—Banner, Birch, McKie & Beckett

[57] ABSTRACT

An improved engine driven air conditioning apparatus for heating and cooling an enclosed space is disclosed. The apparatus includes a compressor linked to a reversing valve. The reversing valve is further linked to a pair of interior heat exchangers disposed in heat exchanging contact with an enclosed space, and a pair of exterior heat exchangers disposed in air passageways linked to the external environment. The reversing valve controls the direction of flow of fluid in the circuit. In one position, fluid flows from the compressor through the reversing valve to the exterior heat exchanger, to the interior heat exchanger and then back to the compressor to cool the enclosed environment. In a second position, the flow is reversed to heat the enclosed environment. The apparatus also includes an engine to drive the compressor, and a cooling circuit associated with the engine. The cooling circuit includes a pair of radiators radiating the heat from the coolant. The radiators are disposed in the air passageways adjacent to the exterior heat exchangers. Each exterior heat exchanger is disposed adjacent one radiator, and both the exterior heat exchangers and the radiators extend substantially throughout the entire cross-sectional area of the air passageways.

9 Claims, 3 Drawing Sheets

ENGINE DRIVEN AIR CONDITIONING APPARATUS

BACKGROUND OF THE INVENTION

1. Technical Field

This invention relates to an engine driven air conditioning apparatus, and more particularly, to a heat exchanging system for an air conditioning apparatus.

2. Description of the Prior Art

Engine driven air conditioning apparatuses are known in the prior art as shown in FIG. 1. The air conditioning apparatus includes compressor 3 driven by engine 4. Reversing valve 5 is connected between the ports of compressor 3, and controls the direction of flow of the working medium or fluid through the circuit of the air conditioning apparatus. Interior heat exchanges 9*a* and 9*b*, are disposed in an enclosed interior environment and are linked to reversing valve 5 through check valves 24*c* and 24*b*, respectively, which allow fluid flow from reversing valve 5 to the interior heat exchangers. Check valve 24*d* and stop valve 25*d* are disposed in series, and the series is disposed in parallel to check valve 24*c*, and allows fluid flow from interior exchanger 9*a* to reversing valve 5 when valve 25*d* is opened. Similarly, check valve 24*a* and stop valve 25*c* are disposed in series, and this series is disposed in parallel to check valve 24*b* and allows fluid flow from interior exchanger 9*b* to reversing valve 5 when valve 25*c* is opened.

Exterior heat exchangers 17*a* and 17*b* are disposed in exterior air passages 26*a* and 26*b*, and are linked to interior heat exchangers 9*a* and 9*b* through further elements of the fluid circuit. Expansion valve 10*b* and check valve 15*b* are disposed in parallel and are linked on one side to interior heat exchanger 9*b*. The other side of the parallel arrangement is linked to stop valve 25*a*. Similarly, expansion valve 10*a* and check valve 15*a* are disposed in parallel and are linked on one side to interior heat exchanger 9*a*. The other side of this parallel arrangement is linked to stop valve 25*b* which is disposed in parallel to stop valve 25*a*. Check valves 15*a* and 15*b* allow fluid flow therethrough in a direction from the interior exchangers to stop valves 25*b* and 25*a*, and prevent fluid flow in the opposite direction. Fluid flow in the opposite direction occurs through expansion valves 10*a* and 10*b*. The other side of stop valves 25*a* and 25*b* are jointly linked to one side of arrangement 100 which includes stop valve 25*e* and expansion valve 14*a* arranged in series; expansion valve 14*b* disposed in parallel to the series, and check valve 16 also disposed in parallel to the series and allowing fluid flow therethrough in a direction towards the interior heat exchangers. Check valve 16 prevents fluid flow in the opposite direction. Thus, fluid flow in the opposite direction must occur through expansion valve 14*b*, and through expansion valve 14*a* when stop valve 25*e* is open to allow fluid flow therethrough. The other side of arrangement 100 is linked to exterior heat exchangers 17*a* and 17*b*. Finally, exterior exchangers 17*a* and 17*b* are linked to reversing valve 5.

When the air conditioning apparatus functions in heating mode, reversing valve 5 assumes the configuration shown in solid line in FIG. 1. Working medium flows from compressor 3, via valve 5 through check valves 24*c* and 24*b* to interior heat exchangers 9*a* and 9*b*. The compressed working medium condenses in the interior heat exchangers and radiates heat to the enclosed interior environment. The condensed fluid flows through check valves 15*a* and 15*b*, bypassing expansion valves 10*a* and 10*b*, through stop valves 25*b* and 25*a*, to arrangement 100. The fluid flows through expansion valve 14*b* to exterior heat exchangers 17*a* and 17*b*. If the quantity of fluid exceeds the capacity of expansion expansion valve 14*b*, the fluid flows through expansion valve 14*a* as well, via stop valve 25*e*. The working fluid absorbs heat and vaporizes in the exterior heat exchangers. The heated fluid medium flows to reversing valve 5 and back to compressor 3 where it is compressed for further circulation through the apparatus.

When the apparatus functions in the cooling mode, reversing valve 5 assumes the configuration shown in the broken line in FIG. 1. Working medium flows from compressor 3, via valve 5, to exterior heat exchangers 17*a* and 17*b*. The working medium condenses in the exterior heat exchangers and releases heat, and flows through check valve 16, bypassing expansion valves 14*b* and 14*a* of arrangement 100. The medium flows through parallel stop valves 25*a* and 25*b*, and parallel expansion valves 10*a* and 10*b* to interior heat exchangers 9*a* and 9*b*. The medium absorbs heat and vaporizes in interior heat exchanger 9*a* and 9*b*, cooling the enclosed environment, and then flows back to compressor 3 through reversing valve 5 for compression and further circulation.

The apparatus also includes a cooling circuit to cool engine 4. Engine coolant which is used to cool engine 4 circulates through the cooling circuit which includes first pair of radiators 18*a* and 18*b* and second pair of radiators 19*a* and 19*b*. Coolant is circulated through the cooling circuit by water pump 22 disposed in the circuit between engine 4 and the radiators. Electromagnetic valves 21*a* and 21*b* are disposed in parallel between engine 4 and the pairs of radiators. Valve 21*a* controls fluid flow to first radiators 18*a* and 18*b*, and valve 21*b* controls coolant flow to second radiators 19*a* and 19*b*. Radiators 18*b* and 18*a* extend substantially adjacent to exterior heat exchangers 17*a* and 17*b* in passages 26*a* and 26*b*. Fan 23 is disposed generally between and above the exterior heat exchangers to circulate air through passages 26*a* and 26*b* in the direction of the arrows. Heat is transferred from radiators 18*a* and 18*b* to exterior heat exchangers 17*a* and 17*b* due to air flow, and due to conduction. Radiators 19*a* and 19*b* are disposed behind a thermally insulating barrier (shown in dashed lines) from the exterior heat exchangers to substantially prevent heat transfer therebetween.

During the heating mode of the apparatus, electromagnetic valve 21*a* is opened and electromagnetic valve 21*b* is closed, that is, coolant flows through valve 21*a* and is prevented from flowing through valve 21*b*. Thus, heated engine coolant flows through first radiators 18*a* and 18*b* located adjacent to exterior heat exchangers 17*a* and 17*b* and waste heat from engine 4 is transferred to the working medium circulating through the exterior heat exchangers. The medium absorbs heat and vaporizes. In contrast, when the apparatus is operating in the cooling mode, electromagnetic valve 21*a* is closed, and electromagnetic valve 21*b* is opened, allowing fluid flow from engine 4 to second radiators 19*a* and 19*b*. Engine heat is not transferred from radiators 19*a* and 19*b* to heat exchangers 17*a* and 17*b*, and working medium in the exterior heat exchangers radiates heat and condenses during the cooling mode of the apparatus.

The disposition of second radiators 19*a* and 19*b* in the cross-sectional area of airflow spaces 26*a* and 26*b*, reduces the cross-sectional area of passages 26*a* and 26*b* occupied by exterior heat exchangers 17*a* and 17*b*. Thus, the heating capacity of the apparatus is not as large as it could be. Furthermore, the provision of both first and second pairs of radiators 18*a* and 18*b*, and 19*a* and 19*b* complicates the construction of the apparatus and necessitates the additional provision of electromagnetic valves 21*a* and 21*b* to control the flow of coolant. Finally, a time delay occurs when electromagnetic valves 21*a* and 21*b* are switched, which may result in the blocking of the flow of engine coolant to the radiators for a significant period of time, possibly causing the engine to overheat.

SUMMARY OF THE INVENTION

It is an object of the present invention to provide an improved air conditioning apparatus with increased capacity during heating mode.

It is another object of the present invention to provide an air conditioning apparatus having a simplified construction.

It is a further object of the present invention to provide an air conditioning apparatus which does not require the use of electromagnetic valves to control the flow of engine coolant.

These and other objects are achieved in accordance with the present invention by providing an engine driven air conditioning apparatus including a compressor for compressing a working medium through a fluid circuit, an engine for driving the compressor, and a reversing valve for controlling the flow direction of the working medium in the circuit. The circuit further includes at least one interior heat exchanger for heating and cooling air in an enclosed area, and at least one exterior heat exchanger for absorbing and radiating heat from the surrounding atmosphere. The direction of fluid flow from the compressor to either the interior or exterior heat exchangers for either heating or cooling mode, respectively, is controlled by the reversing valve. The apparatus further includes a cooling circuit for cooling the engine. Coolant flows through the cooling circuit which includes one radiator disposed adjacent to each exterior heat exchanger. The radiators and the exterior heat exchangers are disposed substantially across the entire exterior openings through which the surrounding atmosphere circulates, to maximize heating capacity.

Other objects, features and other aspects of this invention will be understood from a detailed description of the preferred embodiments of this invention.

DETAILED DESCRIPTION OF THE PREFERRED EMBODIMENTS

Figure 1:
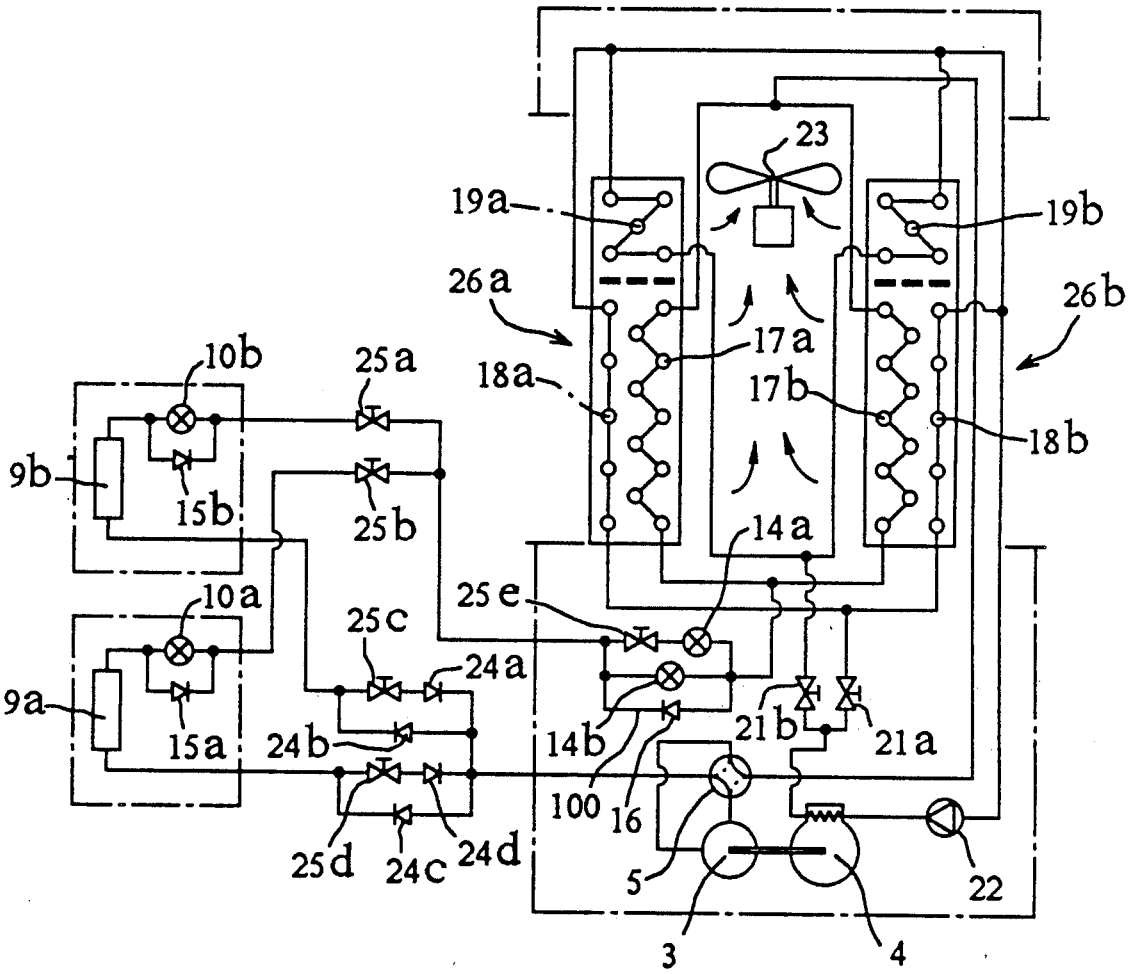
FIG. 1 (PRIOR ART)
FIG. 1 is a circuit diagram showing a prior art air conditioning apparatus.
Figure 2:
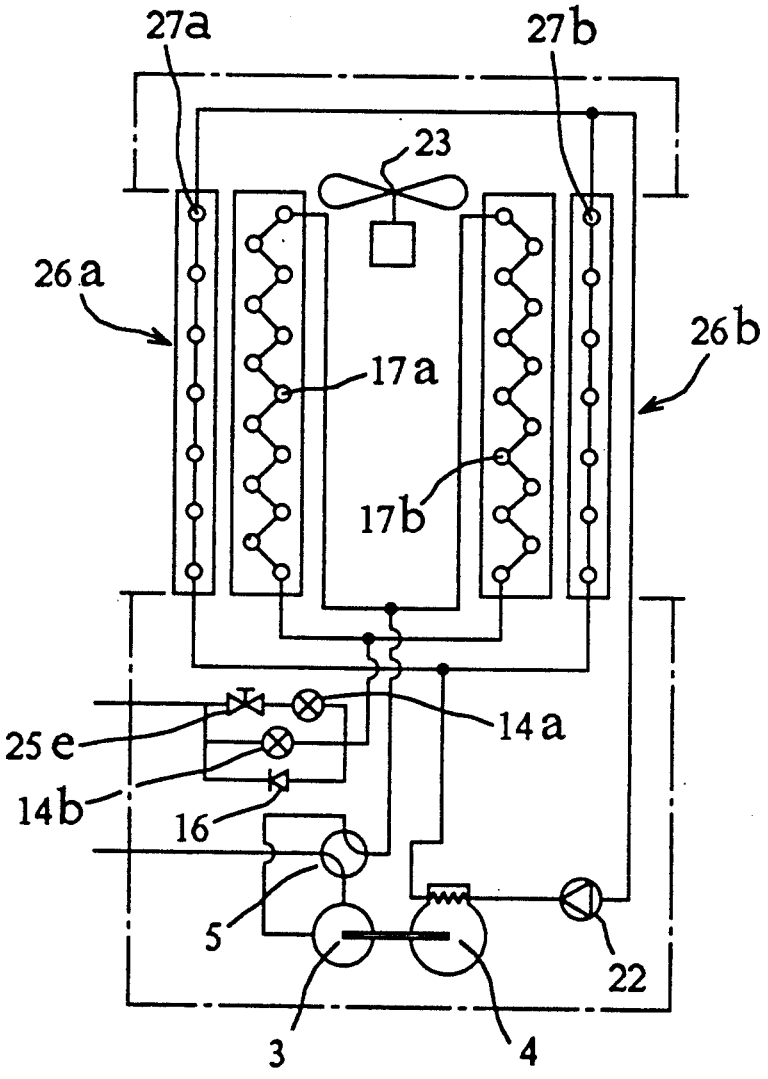
FIG. 2 is a circuit diagram showing an air conditioning apparatus in accordance with a first embodiment of this invention.
Figure 3:
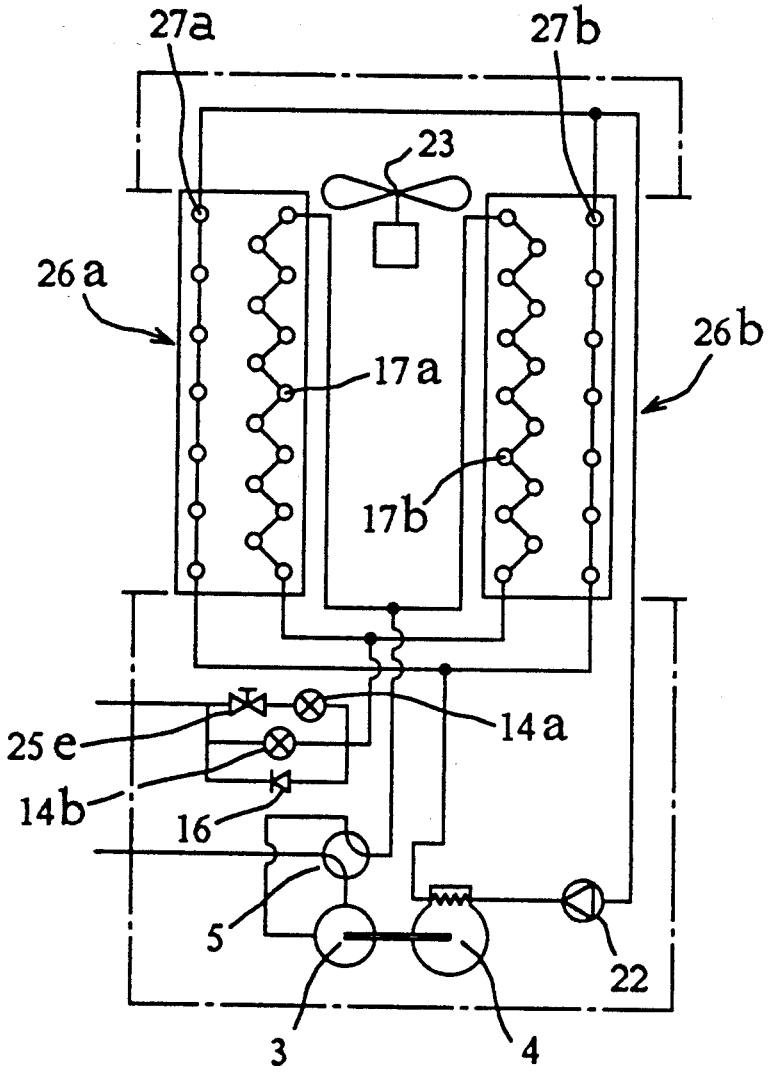
FIG. 3 is a circuit diagram showing an air conditioning apparatus in accordance with a second embodiment of this invention.

In FIGS. 2 and 3, the structure and functioning of the part of the air conditioning apparatus which includes interior heat exchangers 9*a* and 9*b*, expansion valves 10(*a–b*), check valves 15(*a–b*) and 24(*a–d*) and stop valves 25(*a–d*) is similar to the same part of the circuit as discussed in the prior art. Therefore, these elements are not shown in FIGS. 2–3. Additionally, other elements which are similar to elements of the prior art are identified by the same reference numerals.

With reference to FIG. 2, the first embodiment of the present invention is shown. Radiators 27*a* and 27*b* are disposed in exterior airflow passages 26*a* and 26*b*, respectively, between engine 4 and water pump 22 in the cooling circuit. Exterior heat exchangers 17*a* and 17*b* are also disposed in air flow passages 26*a* and 26*b*, respectively, substantially downstream of radiators 27*a* and 27*b* with respect to the circulation of the surrounding atmosphere through passages 26*a* and 26*b*. Radiators 27*a* and 27*b* have substantially the same cross-sectional area as exterior heat exchangers 17*a* and 17*b*, and both the exterior heat exchangers and the radiators extend substantially throughout the entire cross-sectional area of air flow passages 26*a* and 26*b*. Fan 23 is disposed to circulate external air through the air passages, sequentially through the radiators and the exterior heat exchangers.

Engine coolant from the cooling circuit flows through radiators 27*a* and 27*b* whenever compressor 3 is driven by engine 4. That is, coolant flows through radiators 27*a* and 27*b* when the apparatus works in both heating and cooling modes. Therefore, heat from engine 4 is carried to radiators 27*a* and 27*b* by the coolant, and transferred to exterior heat exchangers 17*a* and 17*b* by the flow of air through passages 26*a* and 26*b* whenever the engine is operating and the air conditioning apparatus functions in either heating or cooling mode. Additionally, frost generation on exterior heat exchangers 17*a* and 17*b* is avoided and, since engine coolant always flows directly from the engine to radiators 27*a* and 27*b*, electromagnetic valves are not needed to switch between two sets of radiators, and the blocking of coolant flow is prevented.

When the apparatus functions in the heating mode, heat from radiators 27*a* and 27*b* is supplied to the working medium within exterior heat exchangers 17*a* and 17*b*. Outside air is warmed as it flows through radiators 27*a* and 27*b*, and flows through and warms exterior exchangers 17*a* and 17*b*, heating the working medium within the exchangers. The medium absorbs heat and vaporizes. The vaporized fluid is compressed and flows to interior exchangers 9*a* and 9*b*, condenses therein and releases heat. In typical winter operating conditions, radiators 27*a* and 27*b* heat the outdoor air from 7° C. to 12° C. before it passes over the exterior exchangers. The capacity of operation in the heating mode is improved about 12% over the as compared to operation of the apparatus without radiators disposed near the exchangers. Even if the temperature of the outside air is very low, high capacity operation of the apparatus is maintained during heating mode since the heat exchangers and radiators extend substantially throughout the cross-sectional area of passages 26*a* and 26*b*.

During cooling mode, working medium flows from compressor 3 to exterior heat exchangers 17*a* and 17*b*, wherein the medium releases heat to the outside environment and condenses. The increase in dimensions of the exterior heat exchangers also results in a slight increase in cooling capacity over the prior art. However, since only one pair of radiators is provided, and since the radiators are disposed adjacent the exterior heat exchangers, the exterior heat exchangers receive heat from the engine even during cooling mode. During typical summer operating conditions, the radiators increase the temperature of the outside air from 35° C. to 40° C. before it passes over the exterior exchangers. The cooling capacity of the apparatus is decreased by about 4% as compared to operation of the apparatus without radiators disposed near the exchangers. Thus, as will be explained below, the net capacity of the air conditioning system is decreased during cooling mode. However, the decrease in cooling capacity is substantially less than the increase in heating capacity provided by the present invention.

The difference between the relatively large increase in heating capacity as compared with the small decrease in cooling capacity of the invention can be explained as follows:

During cooling mode, the working medium is directly transmitted to exterior heat exchangers 17*a* and 17*b*, wherein the medium receives heat supplied from radiators 27*a* and 27*b*. The temperature of the air flowing through the exterior heat exchangers is increased by about 5° C. by the radiators, increasing the condensing temperature of the working medium by about 5° C. The increased temperature causes the pressure at the output of the compressor to be increased as compared to the situation when no radiators are provided. High output pressure causes more internal leakage of the working medium within the compressor due to the increased difference between the output and input pressures. Therefore, the volume of working fluid output from the compressor is reduced, decreasing the cooling capacity. The increase in cooling capacity due to the increased size of the exchangers, combined with the decrease in cooling capacity due to the internal leakage results in a small net loss in cooling capacity over the prior art.

In contrast, during heating mode the heating capacity of the apparatus is increased due to the provision of exterior heat exchangers of larger dimension. Since the exterior air is heated by about 5° C. as it flows over radiators 27*a* and 27*b*, the vaporization temperature of the medium is increased by about 5° C. within the exterior heat exchangers. However, since the medium flows in the opposite direction in the circuit in heating mode, it is the input and not the output pressure of the compressor which is increased due to the radiators. Since interior heat exchangers 9*a* and 9*b* are not disposed near the radiators, the output pressure is not increased. Thus, there is no increase in internal leakage loss, and the capacity of the apparatus is not decreased as it is in the cooling mode. Additionally, the mass of heated fluid medium flowing into the compressor is increased due to the larger size of the exchangers, increasing the heating capacity of the apparatus when the medium condenses in the interior exchangers. This combination of factors results in a large increase in heating capacity for the present invention.

With reference to FIG. 3, a second embodiment of the air conditioning apparatus according to the invention is shown. In FIG. 3, radiators 27*a* and 27*b* are formed integrally with exterior heat exchangers 17*a* and 17*b*. Accordingly, heat from the engine coolant is transferred from radiators 27*a* and 27*b* to the working medium in exterior heat exchangers 17*a* and 17*b* by both air flow through passages 26*a* and 26*b* due to the action of fan 23, and by conduction of heat along the integral structure. The operation of the air conditioning apparatus according to the second embodiment is identical to the operation of the first embodiment in all other ways.

This invention has been described in detail in connection with the preferred embodiments. These embodiments, however, are merely for example only, and the invention is not restricted thereto. It will be easily understood, by those skilled in the art, that other variations and modifications can be made easily within the scope of this invention as defined by the appended claims.

I claim:

1. An engine driven air conditioning apparatus for selectively cooling or heating a substantially enclosed space, said apparatus comprising:

a compressor means for compressing a fluid working medium;

an engine means for driving said compressor means;

an interior heat exchanger means for exchanging heat with air within said enclosed space;

an exterior heat exchanger means for exchanging heat with air exterior of said enclosed space;

at least one exterior air flow passage disposed in said apparatus, exterior air flowing through said passage, said exterior heat exchanger means disposed in said exterior airflow passage, said exterior heat exchanger means extending substantially throughout the entire cross-sectional area of said exterior air flow passage;

a cooling circuit including a radiator means for radiating heat, said radiator means linked to said engine, heat generated by said engine flowing to said radiator means;

a reversing valve means linking said compressor means to said interior heat exchanger means and said exterior heat exchanger means, said reversing valve means controlling the flow of fluid working medium such that in one position of said reversing valve means fluid flows from said compressor means to said interior heat exchanger means and said exterior heat exchanger means functions as an evaporator, and in a second position of said reversing means fluid flows from said compressor means to said exterior heat exchanger means and said exterior heat exchanger means functions as a condenser.

2. The apparatus recited in claim 1, said radiator means extending substantially entirely throughout the cross-sectional area of said air flow passage.

3. The apparatus recited in claim 1, said interior heat exchanger means, said exterior heat exchanger means, said reversing valve means and said compressor means forming a heat exchanger circuit, said heat exchanger circuit further comprising an expansion valve means disposed between said interior heat exchanger means and said exterior heat exchanger means, said expansion valve means for reducing the pressure of said working medium as it flows between said interior heat exchanger means and said exterior heat exchanger means, and a check valve means for allowing said fluid medium to bypass said expansion valve means in one direction of flow.

4. The apparatus recited in claim 3, said expansion valve means comprising at least one pair of expansion valves disposed between said interior heat exchanger means and said exterior heat exchanger means, said check valve means including at least one pair of check valves, each said check valve disposed in a parallel arrangement with each said expansion valve, said check valves disposed in said heat exchanger circuit to allow fluid flow through said heat exchanger circuit in opposite directions such that fluid flows through only one said expansion valve in a given direction of flow.

5. The apparatus recited in claim 1, said radiator means positioned upstream of said exterior heat exchanger means in said air passages.

6. The apparatus recited in claim 1, said radiator means formed integrally with said exterior heat exchanger means.

7. The apparatus recited in claim 1, said exterior heat exchanger means comprising only one heat exchanger.

8. The apparatus recited in claim 1, the fluid working medium flowing completely through said exterior heat exchanger means when said reversing valve is in either position.

9. The apparatus recited in claim 1, said air conditioning apparatus comprising a single circuit for both heating and cooling.

* * * * *